United States Patent [19]

Niswonger

[11] Patent Number: 4,996,795

[45] Date of Patent: Mar. 5, 1991

[54] AUTOMATIC GARAGE DOOR DEAD-BOLT LOCK

[76] Inventor: John O. Niswonger, 1947 Silver Spur Cir., Ojai, Calif. 93023

[21] Appl. No.: 459,557

[22] Filed: Jan. 2, 1990

[51] Int. Cl.[5] ..... E05F 15/00

[52] U.S. Cl. ..... 49/280; 49/199; 160/188

[58] Field of Search ..... 49/199, 200, 279, 280; 160/188, 189, 201

[56] References Cited

U.S. PATENT DOCUMENTS

| | | | |
|---|---|---|---|
| 3,704,548 | 12/1972 | Wiegleb | 49/199 |
| 3,708,917 | 1/1973 | Streeter | 49/199 X |
| 4,231,191 | 11/1980 | Ellmore | 49/199 X |
| 4,442,631 | 4/1984 | Weber | 49/199 |
| 4,739,584 | 4/1988 | Zellman | 49/199 |
| 4,805,344 | 2/1989 | Hrboka | 49/199 X |
| 4,827,667 | 5/1989 | Jarvis | 160/189 X |

*Primary Examiner*—Philip C. Kannan
*Assistant Examiner*—Jerry Redman
*Attorney, Agent, or Firm*—Donald A. Streck

[57] ABSTRACT

This is an automatic locking and unlocking mechanism for use with an automatic garage door opening system. A spring-biased locking bar is attached to the garage door for vertical sliding motion. There is a pivot plate mounted to the top of the garage door including a pair of vertical members with a pivot pin disposed between them. A lock-lifting arm is disposed between the vertical members with the pivot pin through a first hole at one end. A connecting cable is connected between a second hole at the other end of the lock-lifting arm and the locking bar. A slider member is disposed between the vertical members and has the operating arm of the automatic garage door opener connected thereto for sliding the slider member. The slider member includes a lifting slot operably connected to the lock-lifting arm for lifting the lock-lifting arm when the slider member is slid to an open and unlocked position and for lowering the lock-lifting arm when the slider member is slid to a closed and locked position. The slider member also has provision for preventing the operating arm of the automatic garage door opener from lifting the top of the garage door to open the garage door until the slider member has slid from the closed and locked position to the open and unlocked position and for preventing the slider member from sliding from the open and unlocked position to the closed and locked position until the operating arm of the automatic garage door opener has lowered the top of the garage door to a fully closed position.

11 Claims, 4 Drawing Sheets

FIG. 4

AUTOMATIC GARAGE DOOR DEAD-BOLT LOCK

BACKGROUND OF THE INVENTION:

This invention relates to mechanisms for opening and closing garage doors automatically and, more particularly, to an automatic locking and unlocking mechanism for use with an automatic garage door opening system wherein a garage door pivoted for opening and closing has an operating arm of an automatic garage door opener connected to a top edge thereof for opening and closing the door comprising, a locking bar attached to the garage door for sliding motion between an extended locked position and a retracted unlocked position, the locking bar being disposed to engage an area peripheral to the garage door only when in the extended locked position; a mounting plate carrying the locking bar for sliding movement between the extended locked position and the retracted unlocked position; biasing means for urging the locking bar to the extended and locked position, the biasing means comprising a spring connected between the mounting plate and the locking bar to urge the locking bar towards the extended locked position; a pivot plate mounted to the top of the garage door, the pivot plate having a pair of vertical members with a pivot pin disposed between them; a lock-lifting arm disposed between the vertical members, the lock-lifting arm having a first hole therethrough adjacent one end thereof having the pivot pin disposed therethrough, the lock-lifting arm having a second hole therethrough adjacent a second end thereof opposite the one end; a connecting cable connected between the second hole in the lock-lifting arm and the locking bar; and, a slider member disposed between the vertical members in combination with the lock-lifting arm for sliding movement therebetween, the slider member having the operating arm of the automatic garage door opener connected thereto for sliding the slider member between the pair of vertical members during opening and closing of the garage door, the slider member having lifting means operably connected to the lock-lifting arm for lifting the second end of the lock-lifting arm when the slider member is slid between the vertical members on the pivot pin from a closed and locked position towards an open and unlocked position and for lowering the second end of the lock-lifting arm when the slider member is slid between the vertical members on the pivot pin from the open and unlocked position to the closed and locked position, the slider member having control means for preventing the operating arm of the automatic garage door opener from lifting the top of the garage door to open the garage door until the slider member has slid from the closed and locked position to the open and unlocked position and for preventing the slider member from sliding from the open and unlocked position to the closed and locked position until the operating arm of the automatic garage door opener has lowered the top of the garage door to a fully closed position.

Garage doors equipped with automatic garage door openers are becoming a common accessory in many modern homes due to the convenience and security of remaining in the car while opening and closing the garage door with the simple push of a button. As depicted in simplified form in FIG. 1, the typical automatic garage door opener includes an opening/closing mechanism 10 which drives a chain 12 (or a worm drive in some models) as a result of signals from a button (in the garage) or a radio frequency opener (from a car). A releasable connecting member 14 attaches an operating arm 16 between the chain 12 and a pivot plate 18 attached to the top center of the garage door 20. To open the garage door 20, the mechanism 10 operates the chain 12 in a counter-clockwise direction to move the connecting member 14 and operating arm 16 from left to right as the figure is viewed. The mechanism 10 pulls the top of the garage door 20 up and backwards to open it about its pivot point (not shown). To close the door 20, the mechanism operates in just the opposite fashion to push the top of the door 20 forward and down.

Unfortunately, automatic garage door openers are not locking mechanism such as a padlock and hasp or a dead-bolt lock, it is relatively easy to overcome the force exerted by the automatic mechanical opening device and gain entry to the garage—and typically to the inside of the house through an unlocked door into the garage as well. Additionally, since the automatic garage door opener engages the garage door only at the top, even if the force of the opening device cannot be overcome in a particular installation, there remains sufficient flex in the garage door at the bottom to allow entry to the garage by prying up the garage door at one corner. Also, inherent in automatic openers is a certain amount of free play in the carriage and arm connections which aid in prying up the garage door. Once inside, of course, a thief can simply pull a release on the actuating arm that connects the top of the garage door to the operating chain or worm drive and then lift the garage door without any impeding force whatsoever.

Since manually locking the garage door before and after each opening and closing eliminates all the convenience and security benefits of the automatic opening device, there is a clear need for a locking mechanism which secures the garage door automatically and in conjunction with the automatic opener.

Heretofore, inventors have created several types of camactivated latching devices which are installed between the carriage and track as in U.S. Pat. Nos. 3,435,558 of Kruse and 3,526,479 of Delaney. While apparently preventing free play in the carriage, these devices do not deal with the inherent flex in the garage door and free play in the arm connections.

The invention of Curtis (U.S. Pat. No. 2,589,479) utilizes a sliding bolt lock which passes over the top edge of the garage door and engages a door frame keeper to prevent unauthorized raising of the garage door. While this design is apparently effective with the roll-up type of garage door which is popular on the east coast of the United States, a single slab door rotating about a center pivot point is a cheaper and more popular instalation on the west coast. Moreover, the keyed outside handle provides a means of entry for any knowledgeable burglar. Additionally, the bell crank arm and companion parts make it awkward and unduly expensive.

Several inventions using automatic garage door locks that function in combination with the carriage movement are illustrated in U.S. Pat. Nos. 3,708,917 (Streeter), 4,442,631 (Weber), and 4,597,224 (TUCKER). These devices vary in the type of delaying mechanism used to unlock the garage door prior to the beginning of its opening cycle. In each case, however, carefully aligned pivot parts and accurately tensioned springs are required, as well as major alterations to the existing garage door operating equipment. These delicately adjusted devices are easily put out of alignment and create recurring maintenance problems. In addition to being expensive to buy, the expertise and the costs involved in altering the existing garage door operating devices put these devices out of the range of the average home owner.

Pat. No. 4,805,344 to Hrboka discloses a much simpler design (depicted in FIG. 2) which does not require substantial alterations of existing equipment. The end of the operating arm 16' connected to the pivot plate 18 has a slot 22 rather than a pivot hole as in the apparatus of FIG. 1. Additionally, there is a heavy deadbolt bar 24 slidably mounted at the bottom of the door 20 which engages a hole (not shown) in the garage floor at the bottom of the door 20 to prevent the door 20 from being raised as described above. The bar 24 is connected to the connecting member 14 through a guide 26 by a connecting cable 28. Thus, as the connecting member 14 moves from left to right as the figure is viewed to raise the door 20, the pivot pin 30 moves along the slot 22 while the cable 28 pulls the bar 24 from its locking hole in the floor. Once the bar 24 is free, the end of the slot 22 pulls on the pivot pin 30 and pulls the door 20 up as in the prior art mechanism of FIG. 1. While the Hrboka apparatus appears to be adequate for its intended use on paper, in actual practice it has several shortcomings that prevent it from being the answer to the problem that the inventor evidently anticipated it would be. For one thing, it relies upon gravity alone to engage the locking mechanism (i.e. lower the bar 24 into its locking hole) and any impediment such as rust or debris may be sufficient to interfere with the locking engagement thereof. Furthermore, upon closing the design lacks any sort of mechanism to keep the lock retracted (i.e. the bar 24 raised) until the garage door closing cycle is completed and the door 20 is fully closed and ready for the bar 24 to engage its locking hole. As a result, the bar tends to drop early and drag on the garage floor with each closing. Not only does this cause damage to the floor and bar 24; but, if the drag on the bar 24 is too great, the automatic opener's pressure safety mechanism (included in most automatic garage door openers to prevent closing the door with something under the door) may be activated and abort the closure of the garage door. Furthermore, since the Hrboka apparatus employs only the simple slot 22 as its "delaying" mechanism, there is no positive control of the door 20 during the opening and closing as in the case of the prior art mechanism of FIG. 1 where there is a pin in a hole at the pivot plat 18 which affords a much greater control of the door 20 during opening and closing. Thus, in the Hrboka apparatus, the door can move freely back and forth in the slot causing substantial stress, wear, and premature aging of the door 20 and the supporting door frame and pivot assembly (not shown) as well as the slot 22 and pivot pin 30.

Wherefore, it is an object of this invention to provide a safe, dependable, easy to install, and inexpensive garage door locking mechanism for automatic garage doors which works simultaneously and in conjunction with an existing garage door opening system.

It is another object of this invention to provide a garage door locking mechanism for automatic garage doors which prevents unauthorized entry into the garage as a result of the inherent flex in the door and free play in the carriage and arm connections by using a bolting system into the floor of the garage at the bottom of the garage door.

It is yet another object of this invention to provide a garage door locking mechanism for automatic garage doors which does not require major alterations to the existing automatic opening system.

It is still another object of this invention to provide a garage door locking mechanism for automatic garage doors which does not require delicate adjustments and constant maintenance in order to function on a reliable, on-going basis.

It is a further object of this invention to provide a garage door locking mechanism for automatic garage doors which has positive spring-actuated lock engagement to insure proper locking of the door each and every time the door is closed.

It is a still further object of this invention to provide a garage door locking mechanism for automatic garage doors which retracts the lock prior to the door beginning its opening cycle and retains the locking bolt in the fully retracted position until the garage door is fully closed.

It is yet a further object of this invention to provide a garage door locking mechanism for automatic garage doors which exerts positive control over the garage door during its entire opening and closing cycle.

Further objects and benefits of the invention will become apparent from the detailed description which follows hereinafter when taken in conjunction with the drawing figures which accompany it.

SUMMARY

The foregoing objects have been attained in an automatic garage door opening system wherein a garage door pivoted for opening and closing has an operating arm of an automatic garage door opener connected to a top edge thereof for opening and closing the door, by the improvement of the present invention for locking and unlocking the garage door in combination with the action of the automatic garage door opener comprising, a locking bar attached to the garage door for sliding motion between an extended locked position and a retracted unlocked position, the locking bar being disposed to engage an area peripheral to the garage door only when in the extended locked position; biasing means for urging the locking bar to the extended and locked position; and, locking and unlocking mechanism means attached to the top of the garage door and connected to the operating arm of the automatic garage door opener and to the locking bar for moving the locking bar to the retracted and unlocked position against a biasing force of the biasing means before allowing the operating arm of the automatic garage door opener to lift the top of the garage door in an opening action and for releasing the locking bar to move to the extended and locked position from the biasing force of the biasing means only after the operating arm of the automatic garage door opener has moved the top of the garage door to a fully closed position.

In the preferred embodiment, there is a mounting plate carrying the locking bar for sliding movement between the extended locked position and the retracted unlocked position and the biasing means comprises a spring connected between the mounting plate and the locking bar to urge the locking bar towards the extended locked position.

Further in the preferred embodiment, the locking and unlocking mechanism means comprises, a pivot plate mounted to the top of the garage door, the pivot plate having a pair of vertical members with a pivot pin disposed between them; a lock-lifting arm disposed between the vertical members, the lock-lifting arm having a first hole therethrough adjacent one end thereof having the pivot pin disposed therethrough, the lock-lifting arm having a second hole therethrough adjacent a second end thereof opposite the one end; a connecting cable connected between the second hole in the lock-lifting arm and the locking bar; and, a slider member disposed between the vertical members in combination with the lock-lifting arm for sliding movement therebetween, the slider member having the operating arm of the automatic garage door opener connected thereto for sliding the slider member between the pair of vertical members during opening and closing of the garage door, the slider member having lifting means operably connected to the lock-lifting arm for lifting the second end of the lock-lifting arm when the slider member is slid between the vertical members on the pivot pin from a closed and locked position towards an open and unlocked position and for lowering the second end of the lock-lifting arm when the slider member is slid between the vertical members on the pivot pin from the open and unlocked position to the closed and locked position, the slider member having control means for preventing the operating arm of the automatic garage door opener from lifting the top of the garage door to open the garage door until the slider member has slid from the closed and locked position to the open and unlocked position and for preventing the slider member from sliding from the open and unlocked position to the closed and locked position until the operating arm of the automatic garage door opener has lowered the top of the garage door to a fully closed position. Additionally, the preferred lifting means comprises, the slider member having an angled slot therethrough disposed between one end and a second end thereof with the angled slot angled upwards from a low point adjacent the second end to a high point adjacent the one end; the lock-lifting arm having a third hole therethrough between the first hole and the second hole; and, a lifting pin connected through the third hole in the lock-lifting arm and the angled slot in the slider member. Also, the preferred control means comprises, the slider member having a horizontal longitudinal slot therethrough adjacent one end with the pivot pin disposed therethrough; the longitudinal slot having an auxiliary hole therethrough adjacent the one end communicating therewith; and, the slider member also having a bottom camming surface disposed for contacting an inside bottom surface of the pivot plate and for pulling the pivot pin from the auxiliary hole into the longitudinal slot as the pivot plate rotates from a door open position with the bottom surface of the pivot plate positioned vertically and a door closed position with the bottom surface of the pivot plate positioned horizontally.

Figure 1:
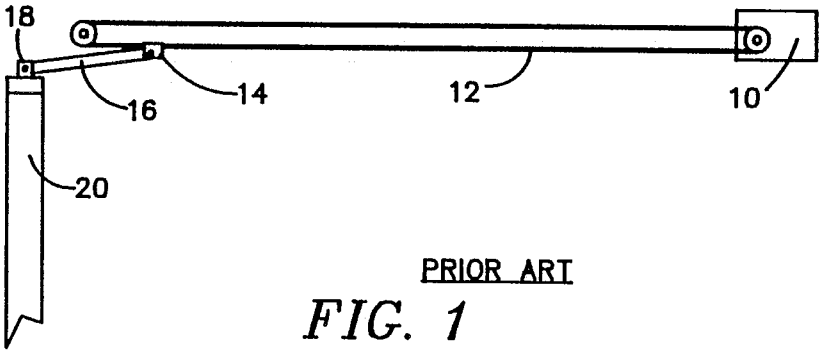
PRIOR ART FIG. 1
FIG. 1 is a simplified drawing showing the elements of a typical prior art automatic garage door opener.
Figure 2:
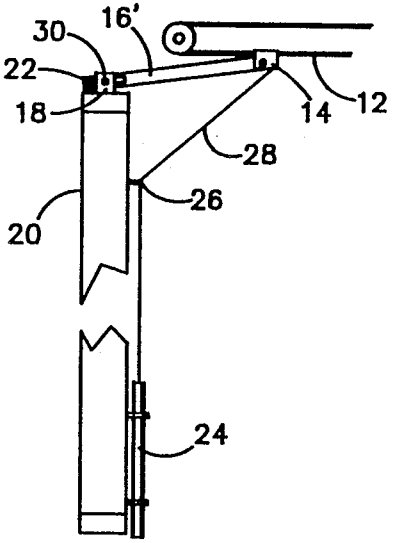
PRIOR ART FIG. 2
FIG. 2 is a simplified drawing showing the elements of a prior art automatic garage door opener incorporating a gravity-operated locking bar therein.
Figure 3:
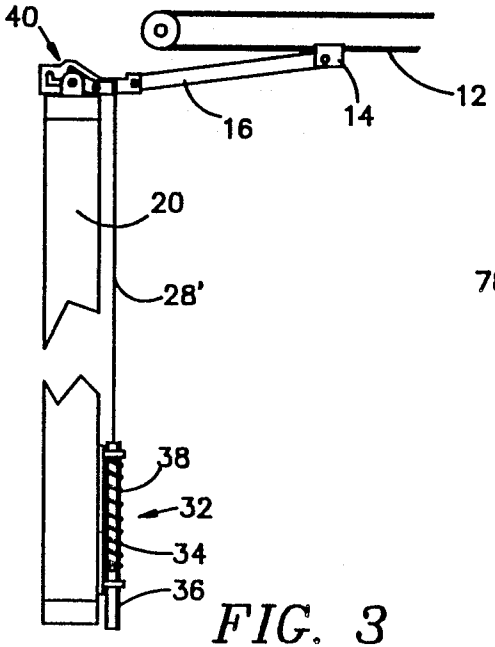
FIG. 3 is a simplified drawing showing the elements of an automatic garage door opener incorporating the dead-bolt locking bar and positive locking and unlocking mechanism of the present invention therein.

Description of the Preferred Embodiment:

The total garage door locking system of the present invention is shown in simplified form in FIG. 3. There is a spring-actuated dead-bolt, generally indicated as 32, attached to the bottom of the garage door 20. The dead-bolt 32 comprises a mounting plate 34 which is bolted to the garage door 20, a locking bar 36 slidably mounted to the mounting plate 34 for vertical sliding movement, and a coil spring 38 disposed about the locking bar 36 and abutting against the mounting plate 34 so as to positively urge the locking bar 36 to a down and locked position engaging hole in the garage floor (not shown) provided for the purpose. The spring-actuated dead-bolt 32 is operated positively in both the locking and unlocking actions thereof by the positive locking and unlocking mechanism 40 which is the principle point of novelty of the present invention. The locking and unlocking mechanism 40, which will be described in detail shortly, is attached to the top of the garage door 20 in place of the prior art pivot plate 18 and has the end of the operating arm 16 connected thereto as well as a cable 28' which lifts the locking bar 36 from its locked position engaging the hole in the garage floor.

Figure 4:
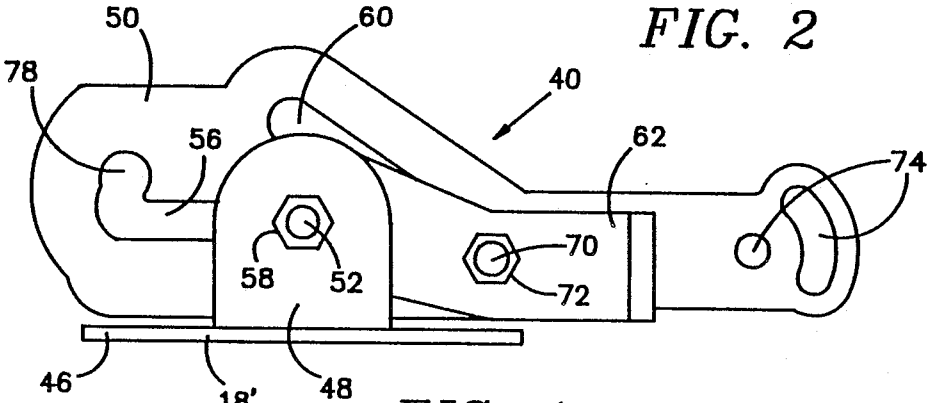
FIG. 4 is a detailed side view of the positive locking and unlocking mechanism of the present invention in its "closed and locked door" position.
Figure 6:
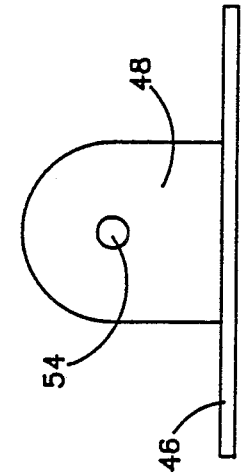
FIG. 6 is a detailed side view of the pivot plate which attaches to the top of the garage door as part of the positive locking and unlocking mechanism of the present invention.
Figure 8:
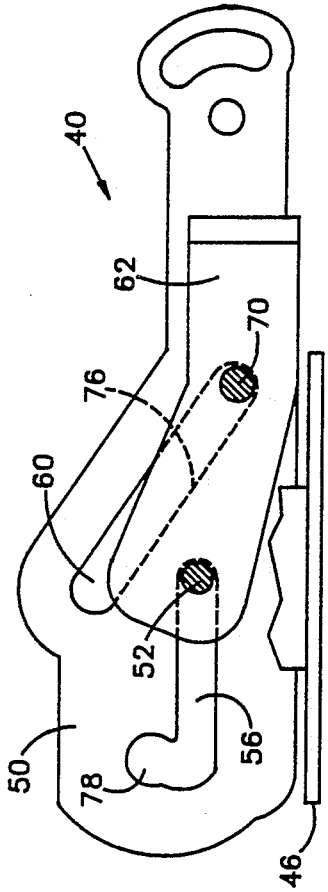
FIG. 8 is a partially cutaway detailed side view of the positive locking and unlocking mechanism of the present invention of FIG. 4 in its "closed and locked door" position and showing how the parts fit together for movement.
Figure 7:
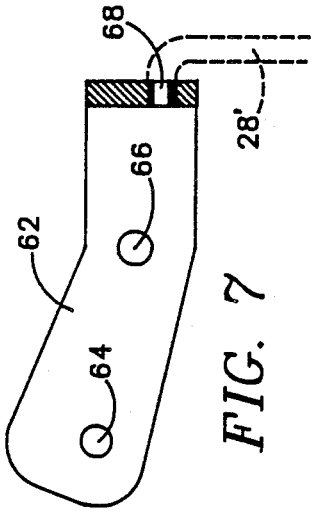
FIG. 7 is a detailed side view of the lock-lifting arm which is part of the positive locking and unlocking mechanism of the present invention.
Figure 10:
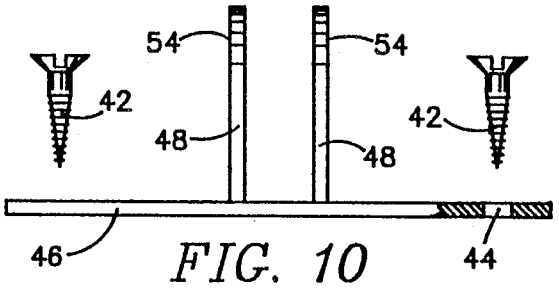
FIG. 10 is a detailed front view of the pivot plate of FIG. 6.

The locking and unlocking mechanism 40 is shown in FIG. 4 in its assembled state as it appears when the garage door 20 is closed and the locking bar 36 is in its locked position engaging the hole in the garage floor. The components of the locking and unlocking mechanism 40 are depicted in FIGS. 5–7 and 10 and the locking and unlocking mechanism 40 is shown in FIG. 8 in its assembled state corresponding to FIG. 4 with portions thereof cut away so as to show the way the components interact. In particular, there is a pivot plate 18' as shown in FIGS. 6 and 10 which is attached to the top of the garage door 20 in place of the pivot plate 18 as with screws 42 through holes 44 therein provided for the purpose. The pivot plate 18' comprises a bottom member 46 having a pair of spaced, parallel upright members 48 extending upwards therefrom. The pivot plate 18' is preferably made from a heavy steel stamping; but, could be a casting if desired.

Figure 5:
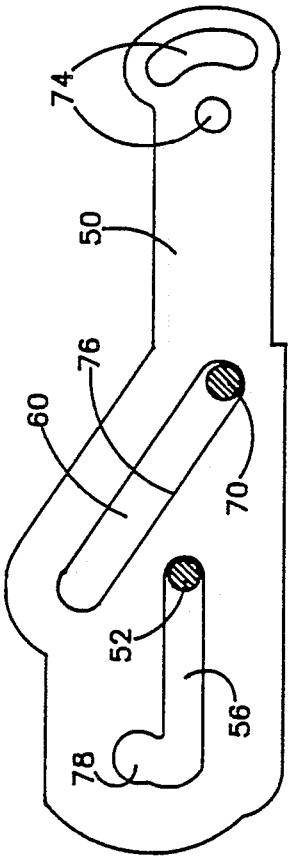
FIG. 5 is a detailed side view of the slider member of the positive locking and unlocking mechanism of the present invention.

The principle component is the slider member 50 shown in FIG. 5. The slider member 50 is positioned between the upright members 48 and a bolt 52 is passed through the holes 54 in the upright members and a longitudinal slot 56 in the slider member 50. The bolt 52 is held in place by a nut 58. A clevis pin and cotter pin could, of course, be used in lieu of the nut 58. In addition to the longitudinal slot 56 (which has additional features to be discussed shortly), the slider member 50 also has an angled slot 60 therein. The third component of the locking and unlocking mechanism 40 is the lock-lifting arm 62 shown in FIG. 7. The arm 62 has three holes in it. Like the slider member 50, the lock-lifting arm 62 is positioned between the upright members 48 and the bolt 52 is also passed through a first hole 64 at one end of the lock-lifting arm 62 to act as a pivot pin for the arm 62. A second hole 66 is located in the center portion of the arm 62 and a second bolt 70 (held in place by a nut 72 or optional clevis pin and cotter pin) is passed through the second hole 66 and the angled slot 60. In the preferred and soon to be commercial embodiment of the invention, a roller sleeve is placed over the second bolt 70 to reduce fiction and wear on the bolt 70 as it moves up and down the slot 60 in the manner to be described hereinafter. The third hole 68 is located at the end of the arm 62 opposite the first hole 64. The cable 28' connected to the locking bar 36 on one end is connected to the hole 68 on its opposite end. The operating arm 16 of the automatic garage door opener (not shown in the drawings for simplicity, convenience and ease of understanding) is attached to the adjustable holes 74 provided in the end of the slider member 50 provided for the purpose.

Figure 9:
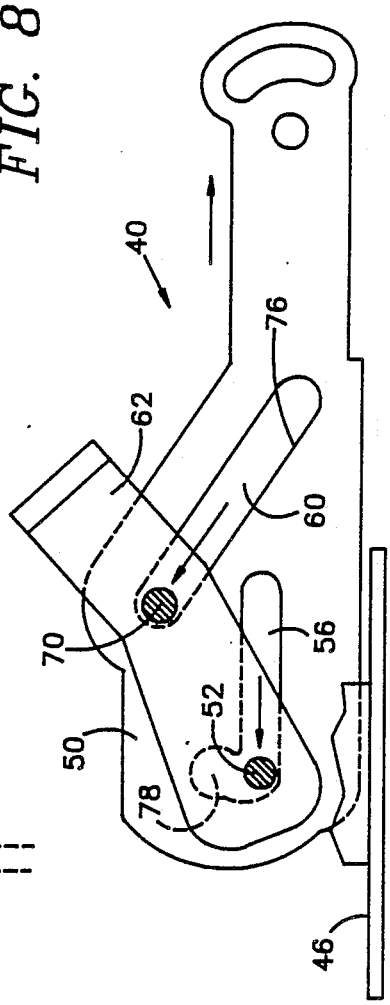
FIG. 9 is a partially cutaway detailed side view of the positive locking and unlocking mechanism of the present invention in the process of opening the garage door to which it is attached at the point where the slider member of FIG. 5 has moved to the point where the pivot pin of the pivot plate of FIG. 6 is at the end of the slot in which it moves and the lock-lifting arm of FIG. 7 has been moved to its fully raised position thereby unlocking the garage door for lifting.

The unique locking and unlocking mechanism 40 of this invention operates in the manner shown in FIGS. 9–15. Starting with the garage door 20 in its closed and locked position, the opening cycle begins as depicted in FIG. 9 with the slider member 50 being pulled to the right as the figure is viewed by the garage door opening mechanism. As the slider member 50 moves towards the right, the bolt 52 moves along the slot 56 and, therefore, no lifting force is initially created on the top of the garage door 20. The bolt 70, however, moves along the angled slot 60 and is lifted by the ramping action of the bottom surface 76 of the slot 60. As the bolt 70 is raised by the action of the angled slot 60, the end of the arm 62 having the hole 68 therein is also raised. As the end of the arm 62 having the hole 68 therein is raised, the cable 28' is raised thereby lifting the locking bar 36 against the force of the spring 38 to unlock the garage door 20.

Figure 11:
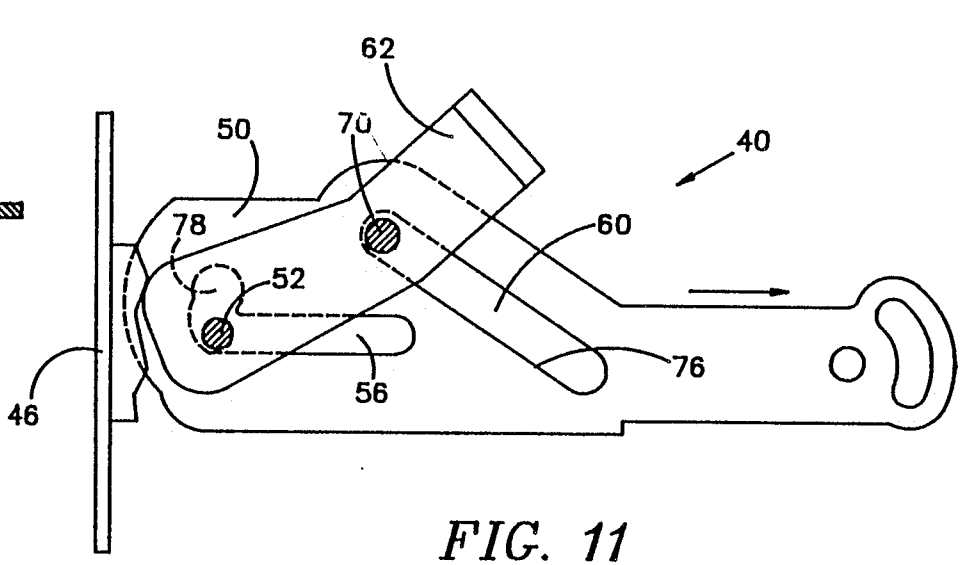
FIG. 11 is a partially cutaway detailed side view of the positive locking and unlocking mechanism of the present invention in the process of opening the garage door to which it is attached at the point where the pivot pin is at the end of the slot and the garage door has been lifted just prior to the slider member dropping from gravity to move the pivot pin into the engaging hole at the end of the slot.
Figure 12:
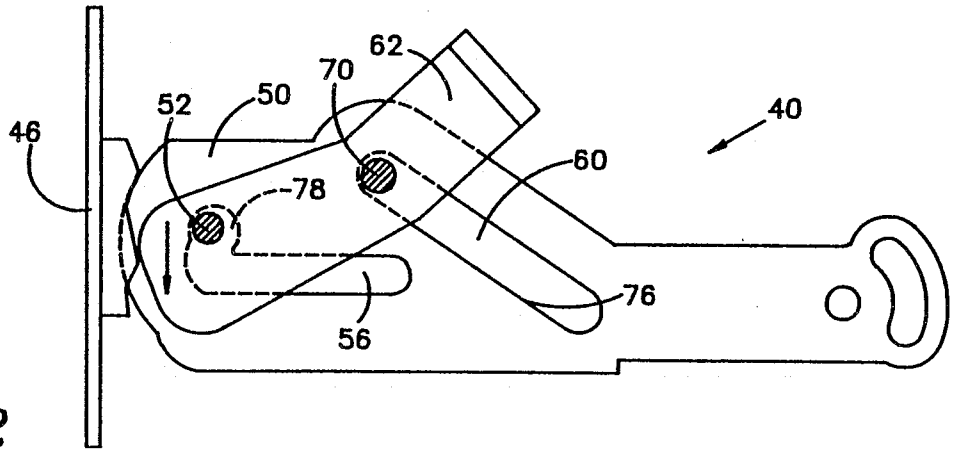
FIG. 12 is a partially cutaway detailed side view of the positive locking and unlocking mechanism of the present invention at the end of the opening process at the point where slider member has dropped from gravity and the pivot pin has moved into the engaging hole at the end of the slot.

Once the locking and unlocking mechanism 40 is in the unlocked position of FIG. 9, the bolt 52 bears against the end of the slot 56 and the top of the garage door 20 is pulled up and back in a conventional opening action by the garage door opener. As the garage door 20 opens, the pivot plate 18' pivots about the bolt 52 until the bottom member 46 is vertical as depicted in FIG. 11. As long as there is pulling tension on the top of the garage door 20 by the end of the slot 56 on the bolt 52, the bolt 52 retains its position in the end of the slot 56 as depicted in FIG. 11. As soon as the garage door 20 is fully open and the tension is released, however, the effect of gravity on the slider member 50 causes the end of the slider member 50 to drop and for the bolt 52 to fall into the auxiliary hole 78 connected to the end of the slot 56 as shown in FIG. 12, where it remains as long as the garage door 20 is open.

Figure 13:
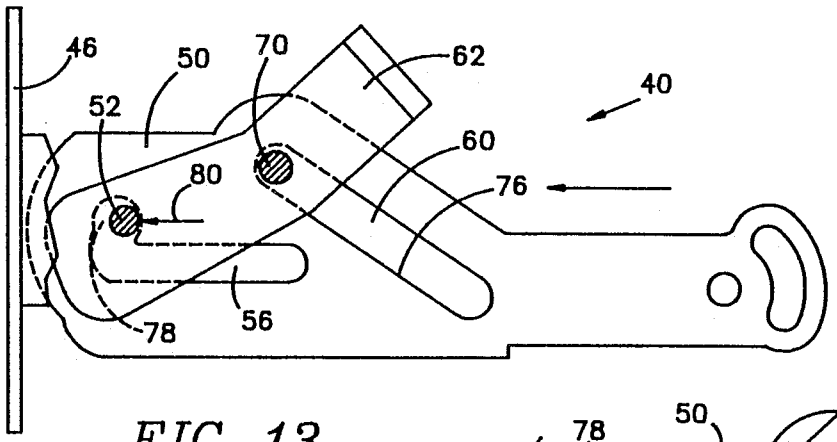
FIG. 13 is a partially cutaway detailed side view of the positive locking and unlocking mechanism of the present invention in the process of closing the garage door to which it is attached at the point where the pivot pin is in the engaging hole at the end of the slot and pushing the top of the garage door towards the closed position.
Figure 14:
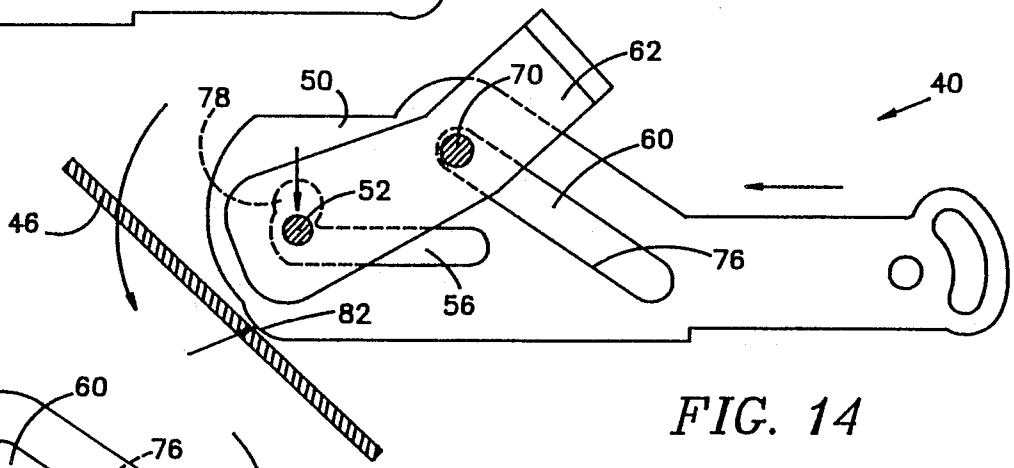
FIG. 14 is a partially cutaway detailed side view of the positive locking and unlocking mechanism of the present invention in the process of closing the garage door to which it is attached at the point where the pivot plate has started to revolve about the pivot pin and the camming surface on the bottom of the slider member is pulling the pivot pin out of the engaging hole and back into the main part of the slot and pushing the top of the garage door towards the closed position as part of the positive closing action of the present invention.
Figure 15:
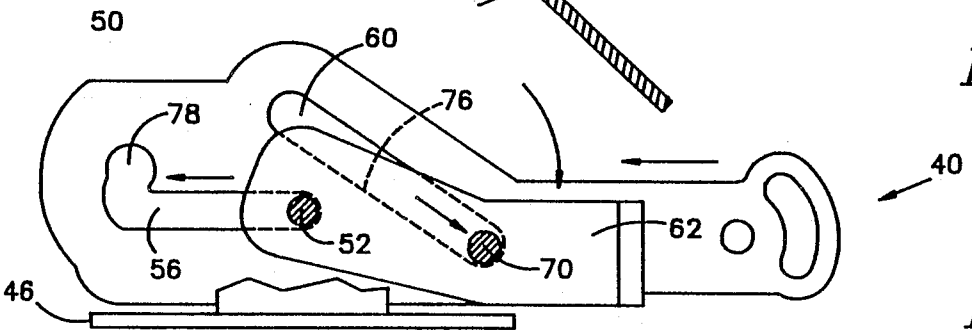
FIG. 15 is a partially cutaway detailed side view of the positive locking and unlocking mechanism of the present invention in the process of locking the garage door to which it is attached at the point where the pivot plate has fully revolved about the pivot pin, the door is closed, and the pivot pin is sliding along the main part of the slot as the slider member continues to move forward and the lock-lifting arm is moving from its fully raised position to its fully lowered position thereby locking the garage door.

When the garage door is closed, the action beginning in FIG. 13 takes place. Since the bolt 52 is in the auxiliary hole 78, as the slider member 50 is pushed from right to left as the figure is viewed by the garage door opener's operating arm 16, the inner surface of the auxiliary hole 78 pushes against the bolt 52 as depicted by the arrow 80 thereby positively pushing the garage door's top edge back towards the closed position with the lock-lifting arm 62 (and therefore the locking bar 36 as well) held in the raised and unlocked position. This positive control relationship remains in effect throughout the door closing procedure. As the garage door 20 approaches its fully closed position, the pivot plate 18' has rotated about the bolt 52 until, as it approaches the position depicted in FIG. 14, the camming bottom surface 82 of the slider member 50 contacts the bottom member 46 of the pivot plate 18' and begins to physically pull the bolt 52 from the auxiliary hole 78. Once the garage door 20 is in its fully closed position and as depicted in FIG. 15, the bolt 52 is fully extracted from the auxiliary hole 78 by the action of the camming bottom surface 82 back into the slot 56. Thereafter, as the garage door opener continues to push the slider member 50 from right to left as the figure is viewed, the bolt 52 moves down the slot 56 thereby imparting no further closing force on the top of the garage door 20; however, simultaneously the bolt 70 is moved along the angled slot 60 thereby lowering the lock-lifting arm 62 and the locking bar 36 (under the force of spring 38) back to the fully locked position.

As those skilled in the art will readily realize and appreciate from the foregoing description, since the locking bar 36 is moved to its extended and locked position by the spring 38 and only pulled against the force of the spring 38 to its unlocked position by the action of the lock-lifting arm 62, multiple locking bars 36 could be incorporated with a single locking and unlocking mechanism 40, desired. To do so, only cable guides for the multiple connecting cables 28' would have to be added with the ends of the multiple connecting cables 28' all terminating in an attachment to the hole 68. For example, two locking bars 36 could be attached to the bottom edge of the garage door 20 with one at each corner. By passing the connecting cables 28' over pulleys to turn them smoothly and easily 90°, a pair of locking bars 36 could be mounted on opposite side edges of the garage door adjacent the bottom edge of the door 20 and lockingly fit into holes (with or without metal guard plates) in the side frame of the garage door. Of course, a combination of side- and bottom-mounted locking bars 36 could be employed in highly sensitive installations requiring the maximum of protection.

Also, while not preferred, those skilled in the art will also recognize that the benefits of the present invention and, in particular, the unique locking and unlocking mechanism 40, can be attained without employing the spring 38 and with the locking bar 36 being of sufficient weight to drop into position (in a vertical orientation only) from the force of gravity as the biasing force.

Thus, it can be seen from the foregoing description that the present invention has truly met its stated objectives by providing a positive-acting locking mechanism for use with automatic garage door openers which operates in a logical and positive manner. Unlike the prior art gravity-operated locking mechanism described earlier which unlocked and opened in a logical manner but then dropped the locking bar prior to closing, the unique mechanism of this invention performs the entire opening and closing operation in a logical manner by first unlocking and raising the door and then lowering the door to its fully closed position before releasing the spring-actuated locking bar.

Wherefore, having thus described my invention, what is claimed is:

1. In an automatic garage door opening system wherein a garage door pivoted for opening and closing has an operating arm of an automatic garage door opener connected to a top edge thereof for opening and closing the door, the improvement for locking and unlocking the garage door in combination with the action of the automatic garage door opener comprising:

(a) a locking bar attached to the garage door for sliding motion between an extended locked position and a retracted unlocked position, said locking bar being disposed to engage an area peripheral to the garage door only when in said extended locked position;

(b) biasing means for urging said locking bar to said extended and locked position; and, (c) locking and unlocking mechanism means attached to the top of the garage door and connected to the operating arm of the automatic garage door opener and to said locking bar for moving said locking bar to said retracted and unlocked position against a biasing force of said biasing means before allowing the operating arm of the automatic garage door opener to lift the top of the garage door in an opening action and for releasing said locking bar to move to said extended and locked position from said biasing force of said biasing means only after the operating arm of the automatic garage door opener has moved the top of the garage door to a fully closed position, said locking and unlocking mechanism means comprising, (c1) a pivot plate mounted to the top of the garage door, said pivot plate having a pair of vertical members with a pivot pin disposed between them, (c2) a lock-lifting arm disposed between said vertical members, said lock-lifting arm having a first hole therethrough adjacent one end thereof having said pivot pin disposed therethrough, said lock-lifting arm having a second hole therethrough adjacent a second end thereof opposite said one end, (c3) a connecting cable connected between said second hole in said lock-lifting arm and said locking bar, and (c4) a slider member disposed between said vertical members in combination with said lock-lifting arm for sliding movement therebetween, said slider member having the operating arm of the automatic garage door opener connected thereto for sliding said slider member between said pair of vertical members during opening and closing of the garage door, said slider member having lifting means operably connected to said lock-lifting arm for lifting said second end of said lock-lifting arm when said slider member is slid between said vertical members on said pivot pin from a closed and locked position towards an open and unlocked position and for lowering said second end of said lock-lifting arm when said slider member is slid between said vertical members on said pivot pin from said open and unlocked position to said closed and locked position, said slider member having control means for preventing the operating arm of the automatic garage door opener from lifting the top of the garage door to open the garage door until said slider member has slid from said closed and locked position to said open and unlocked position and for preventing said slider member from sliding from said open and unlocked position to said closed and locked position until the operating arm of the automatic garage door opener has lowered the top of the garage door to a fully closed position.

2. The improvement to an automatic garage door opening system of claim 1 and additionally comprising:

(a) a mounting plate carrying said locking bar for sliding movement between said extended locked position and said retracted unlocked position; and wherein, (b) said biasing means comprises a spring connected between said mounting plate and said locking bar to urge said locking bar towards said extended locked position.

3. The improvement to an automatic garage door opening system of claim 1 wherein said lifting means comprises:

(a) said slider member having an angled slot therethrough disposed between one end and a second end thereof with said angled slot angled upwards from a low point adjacent said second end to a high point adjacent said one end;

(b) said lock-lifting arm having a third hole therethrough between said first hole and said second hole; and, (c) a lifting pin connected through said third hole in said lock-lifting arm and said angled slot in said slider member.

4. The improvement to an automatic garage door opening system of claim 1 wherein said control means comprises:

(a) said slider member having a horizontal longitudinal slot therethrough adjacent one end with said pivot pin disposed therethrough;

(b) said longitudinal slot having an auxiliary hole therethrough adjacent said one end communicating therewith; and, (c) said slider member also having a bottom camming surface disposed for contacting an inside bottom surface of said pivot plate and for pulling said pivot pin from said auxiliary hole into said longitudinal slot as said pivot plate rotates from a door open position with said bottom surface of said pivot plate positioned vertically and a door closed position with said bottom surface of said pivot plate positioned horizontally.

5. The improvement to an automatic garage door opening system of claim 1 wherein said locking and unlocking mechanism means comprises:

(a) a pivot plate mounted to the top of the garage door, said pivot plate having a pair of vertical members with a pivot pin disposed between them;

(b) a slider member disposed between said vertical members for sliding movement therebetween, said slider member having a horizontal longitudinal slot therethrough adjacent one end with said pivot pin disposed therethrough, said longitudinal slot having an auxiliary hole therethrough adjacent said one end communicating therewith, said slider member having the operating arm of the automatic garage door opener connected to a second end thereof opposite said one end, said slider member further having an angled slot therethrough disposed between said one end and said second end with said angled slot angled upwards from a low point adjacent said second end to a high point adjacent said one end, said slider member also having a bottom camming surface disposed for contacting an inside bottom surface of said pivot plate and for pulling said pivot pin from said auxiliary hole into said longitudinal slot as said pivot plate rotates from a door open position with said bottom surface of said pivot plate positioned vertically and a door closed position with said bottom surface of said pivot plate positioned horizontally;

(c) a lock-lifting arm disposed between said vertical members in combination with said slider member, said lock-lifting arm having a first hole therethrough adjacent one end thereof having said pivot pin disposed therethrough, said lock-lifting arm having a second hole therethrough adjacent a second end thereof opposite said one end, said lock-lifting arm having a third hole therethrough disposed between said one end and said second end;

(d) a lifting pin connected through said third hole in said lock-lifting arm and said angled slot in said slider member; and, (e) a connecting cable connected between said second hole in said lock-lifting arm and said locking bar.

6. In an automatic garage door opening system wherein a garage door pivoted for opening and closing has an operating arm of an automatic garage door opener connected to a top edge thereof for opening and closing the door, the improvement for locking and unlocking the garage door in combination with the action of the automatic garage door opener comprising:

(a) a locking bar attached to the garage door for sliding motion between an extended locked position and a retracted unlocked position, said locking bar being disposed to engage an area peripheral to the garage door only when in said extended locked position;

(b) a mounting plate carrying said locking bar for sliding movement between said extended locked position and said retracted unlocked position;

(c) biasing means for urging said locking bar to said extended and locked position, said biasing means comprising a spring connected between said mounting plate and said locking bar to urge said locking bar towards said extended locked position; and, (d) locking and unlocking mechanism means attached to the top of the garage door and connected to the operating arm of the automatic garage door opener and to said locking bar for moving said locking bar to said retracted and unlocked position against a biasing force of said spring before allowing the operating arm of the automatic garage door opener to lift the top of the garage door in an opening action and for releasing said locking bar to move to said extended and locked position from said biasing force of said spring only after the operating arm of the automatic garage door opener has moved the top of the garage door to a fully closed position, said locking and unlocking mechanism means comprising, (d1) a pivot plate mounted to the top of the garage door, said pivot plate having a pair of vertical members with a pivot pin disposed between them, (d2) a lock-lifting arm disposed between said vertical members, said lock-lifting arm having a first hole therethrough adjacent one end thereof having said pivot pin disposed therethrough, said lock-lifting arm having a second hole therethrough adjacent a second end thereof opposite said one end, (d3) a connecting cable connected between said second hole in said lock-lifting arm and said locking bar, and (d4) a slider member disposed between said vertical members in combination with said lock-lifting arm for sliding movement therebetween, said slider member having the operating arm of the automatic garage door opener connected thereto for sliding said slider member between said pair of vertical members during opening and closing of the garage door, said slider member having lifting means operably connected to said lock-lifting arm for lifting said second end of said lock-lifting arm when said slider member is slid between said vertical members on said pivot pin from a closed and locked position towards an open and unlocked position and for lowering said second end of said lock-lifting arm when said slider member is slid between said vertical members on said pivot pin from said open and unlocked position to said closed and locked position, said slider member having control means for preventing the operating arm of the automatic garage door opener from lifting the top of the garage door to open the garage door until said slider member has slid from said closed and locked position to said open and unlocked position and for preventing said slider member from sliding from said open and unlocked position to said closed and locked position until the operating arm of the automatic garage door opener has lowered the top of the garage door to a fully closed position.

7. The improvement to an automatic garage door opening system of claim 6 wherein said lifting means comprises:

(a) said slider member having an angled slot therethrough disposed between one end and a second end thereof with said angled slot angled upwards from a low point adjacent said second end to a high point adjacent said one end;

(b) said lock-lifting arm having a third hole therethrough between said first hole and said second hole; and, (c) a lifting pin connected through said third hole in said lock-lifting arm and said angled slot in said slider member.

8. The improvement to an automatic garage door opening system of claim 6 wherein said control means comprises:

(a) said slider member having a horizontal longitudinal slot therethrough adjacent one end with said pivot pin disposed therethrough;

(b) said longitudinal slot having an auxiliary hole therethrough adjacent said one end communicating therewith; and, (c) said slider member also having a bottom camming surface disposed for contacting an inside bottom surface of said pivot plate and for pulling said pivot pin from said auxiliary hole into said longitudinal slot as said pivot plate rotates from a door open position with said bottom surface of said pivot plate positioned vertically and a door closed position with said bottom surface of said pivot plate positioned horizontally.

9. An automatic locking and unlocking mechanism for use with an automatic garage door opening system wherein a garage door pivoted for opening and closing has an operating arm of an automatic garage door opener connected to a top edge thereof for opening and closing the door comprising:

(a) a locking bar attached to the garage door for sliding motion between an extended locked position and a retracted unlocked position, said locking bar being disposed to engage an area peripheral to the garage door only when in said extended locked position;

(b) a mounting plate carrying said locking bar for sliding movement between said extended locked position and said retracted unlocked position;

(c) biasing means for urging said locking bar to said extended and locked position, said biasing means comprising a spring connected between said mounting plate and said locking bar to urge said locking bar towards said extended locked position;

(d) a pivot plate mounted to the top of the garage door, said pivot plate having a pair of vertical members with a pivot pin disposed between them;

(e) a lock-lifting arm disposed between said vertical members, said lock-lifting arm having a first hole therethrough adjacent one end thereof having said pivot pin disposed therethrough, said lock-lifting arm having a second hole therethrough adjacent a second end thereof opposite said one end;

(f) a connecting cable connected between said second hole in said lock-lifting arm and said locking bar; and, (g) a slider member disposed between said vertical members in combination with said lock-lifting arm for sliding movement therebetween, said slider member having the operating arm of the automatic garage door opener connected thereto for sliding said slider member between said pair of vertical members during opening and closing of the garage door, said slider member having lifting means operably connected to said lock-lifting arm for lifting said second end of said lock-lifting arm when said slider member is slid between said vertical members on said pivot pin from a closed and locked position towards an open and unlocked position and for lowering said second end of said lock-lifting arm when said slider member is slid between said vertical members on said pivot pin from said open and unlocked position to said closed and locked position, said slider member having control means for preventing the operating arm of the automatic garage door opener from lifting the top of the garage door to open the garage door until said slider member has slid from said closed and locked position to said open and unlocked position and for preventing said slider member from sliding from said open and unlocked position to said closed and locked position until the operating arm of the automatic garage door opener has lowered the top of the garage door to a fully closed position.

10. The automatic locking and unlocking mechanism for use with an automatic garage door opening system of claim 9 wherein said lifting means comprises:

(a) said slider member having an angled slot therethrough disposed between one end and a second end thereof with said angled slot angled upwards from a low point adjacent said second end to a high point adjacent said one end;

(b) said lock-lifting arm having a third hole therethrough between said first hole and said second hole; and, (c) a lifting pin connected through said third hole in said lock-lifting arm and said angled slot in said slider member.

11. The automatic locking and unlocking mechanism for use with an automatic garage door opening system of claim 9 wherein said control means comprises:

(a) said slider member having a horizontal longitudinal slot therethrough adjacent one end with said pivot pin disposed therethrough;

(b) said longitudinal slot having an auxiliary hole therethrough adjacent said one end communicating therewith; and, (c) said slider member also having a bottom camming surface disposed for contacting an inside bottom surface of said pivot plate and for pulling said pivot pin from said auxiliary hole into said longitudinal slot as said pivot plate rotates from a door open position with said bottom surface of said pivot plate positioned vertically and a door closed position with said bottom surface of said pivot plate positioned horizontally.

* * * * *